United States Patent [19]

Clarke

[11] Patent Number: 4,508,635

[45] Date of Patent: Apr. 2, 1985

[54] GENERAL-PURPOSE CLEANING COMPOSITION COMPRISING NONIONIC SURFACTANT AND ALCOHOL ESTERIFIED RESIN COPOLYMER

[75] Inventor: David E. Clarke, Bromborough, England

[73] Assignee: Lever Brothers Company, New York, N.Y.

[21] Appl. No.: 580,499

[22] Filed: Feb. 15, 1984

Related U.S. Application Data

[63] Continuation-in-part of Ser. No. 378,658, May 17, 1982.

[30] Foreign Application Priority Data

May 29, 1981 [GB] United Kingdom ..... 8116439

[51] Int. Cl.[3] ..... C11D 1/66; C11D 15/04

[52] U.S. Cl. ..... 252/174.23; 106/13; 252/70; 252/89.1; 252/156; 252/173; 252/174.21; 252/174.24; 252/DIG. 1; 252/DIG. 2; 252/DIG. 10; 252/DIG. 14

[58] Field of Search ..... 252/173, 174.23, 174.24, 252/89.1, 156, 174.21, DIG. 1, DIG. 2, DIG. 10, DIG. 14, 70; 106/13

[56] References Cited

U.S. PATENT DOCUMENTS

| | | | |
|---|---|---|---|
| 3,388,106 | 6/1968 | Muskat | 525/327.7 |
| 3,679,592 | 7/1972 | Schomburg | 252/153 |
| 3,741,940 | 5/1973 | Heilman | 525/383 |
| 3,835,071 | 9/1974 | Allen et al. | 252/551 X |
| 4,082,684 | 4/1978 | Kreischer | 252/109 |

OTHER PUBLICATIONS

M. Schick's Textbook, "Nonionic Surfactants", M. Dekker Inc., New York, 1967.

*Primary Examiner*—John E. Kittle
*Assistant Examiner*—Mukund J. Shah
*Attorney, Agent, or Firm*—Milton L. Honig; James J. Farrell

[57] ABSTRACT

A liquid general-purpose cleaner, having improved nonstreak and cleaning properties is obtained by inclusion, in a liquid compatible medium, of an at least 5% alcohol esterified resin copolymer and a nonionic surfactant having an HLB-value of between 10 and 15. The composition contains generally less than 5% of inorganic electrolyte salts, and can be applied to hard surfaces either in dilute form or neat.

9 Claims, No Drawings

GENERAL-PURPOSE CLEANING COMPOSITION COMPRISING NONIONIC SURFACTANT AND ALCOHOL ESTERIFIED RESIN COPOLYMER

CROSS-REFERENCE TO OTHER APPLICATIONS

This application is a continuation-in-part of my earlier application Ser. No. 378,658, filed May 17, 1982.

BRIEF SUMMARY OF THE INVENTION

The present invention relates to general-purpose cleaning compositions with improved properties.

General-purpose cleaning compositions are compositions which are intended for use in the cleaning of hard surfaces, such as tiles, walls, floors, kitchen furniture, glass, plastic-covered doors, etc. Such general-purpose cleaning compositions are well-known in the art and have found substantial commercial use.

These compositions are usually provided in the form of a particulate composition, from which the user prepares an aqueous solution, or in the form of a liquid composition which contains a suitable solvent, such as water or an organic solvent, or a mixture of these. These liquids can be applied either neat for the removal of stubborn stains, or in the form of a more diluted solution for large surface area cleaning.

However, despite the fact that many of such general-purpose cleaning compositions often satisfactorily remove soil and dirt from hard surfaces, they often leave behind residues once the solvent medium has evaporated during the drying of the cleaned surface. The surface presents residues, visible as dull streaks, instead of the bright, shining surface that the consumer wants to see.

It is therefore an object of the present invention to provide general-purpose cleaning compositions with a "streak-free" cleaning benefit, i.e. after cleaning a hard surface with such a cleaning composition the hard surface, when dry, does not show a residue in the form of visible, dull streaks to any significant degree.

For brevity's sake, such a cleaning composition will hereafter be called a streak-free general-purpose cleaning composition, "streak-free" being understood as described hereabove.

PRIOR ART

Cleaning compositions with such reduced streaking properties have already been described in the art. Thus, U.S. Pat. No. 3,696,043 (Labarge) discloses a cleaning composition for glass and reflective surfaces comprising a solution of an anionic or a nonionic detergent surfactant and a soluble salt of a non-esterified copolymer of a monovinyl aromatic monomer and an unsaturated dicarboxylic acid or an anhydride thereof. In U.S. Pat. No. 3,679,592 (Schomburg) it has been proposed to include half-alkylesters of such copolymers in cleansing and soil preventive compositions, containing anionic, nonionic, zwitterionic or ampholytic synthetic detergents. These compositions also contain 0.5 to 5% by weight of a scale inhibitor. In both the above prior proposals, various types of different groups of synthetic detergents can be used indiscriminately.

DETAILED DESCRIPTION

It has now been found that a liquid general-purpose cleaning composition with improved non-streak properties and improved cleaning properties can be obtained by including in a compatible liquid medium which contains an at least partially esterified resin, a nonionic detergent surfactant having an HLB-value of between 10 and 15.

The compatible liquid medium may consist of water, or mixtures of water and one or more water-miscible organic solvents. Typical examples of such solvents are the lower aliphatic water-miscible alcohols such as ethanol, propanol, isopropanol, butanol and so on. Other alcohols, such as tetrahydrofurfurol, may also be used. Glycols, such as ethylene- and propylene-glycol and glycolethers, such as the mono and dimethyl, -propyl, -isopropyl, -butyl, -isobutylethers of ethyleneglycol, di- and tri-ethyleneglycol may also be used. Analogous propyleneglycolethers may also be used.

In general, the liquid medium will make up from 1 to 99.985% by weight of the final composition. Normally, this will be from 50 to 97.9%, and preferably from 55 to 92.5% by weight of the final composition.

The nonionic detergent surfactant used in the present invention can be any suitable type of nonionic detergent known. Basically, nonionic detergent surfactants consist of a hydrophobic moiety, such as a $C_8$–$C_{20}$ primary or secondary, branched or straight chain monoalcohol, a $C_8$–$C_{18}$ mono- or dialkylphenol, a $C_8$–$C_{20}$ fatty acid amide, and a hydrophilic moiety which consists of alkylene oxide units. These nonionic detergent surfactants are for instance alkoxylation products of the above hydrophobic moieties, containing from 2 to 30 moles of alkylene oxide. As alkylene oxides ethylene-, propylene- and butylene-oxides and mixtures thereof are used.

Typical examples of such nonionic detergents are $C_9$–$C_{11}$ primary, straight-chain alcohols condensed with from 4–9 moles of ethylene oxide, $C_{12}$–$C_{15}$ primary straight-chain alcohols condensed with from 6–12 moles of ethylene oxide, or with 7–9 moles of a mixture of ethylene- and propylene-oxide, $C_{11}$–$C_{15}$ secondary alcohols condensed with from 3–15 moles of ethylene oxide, and $C_{10}$–$C_{18}$ fatty acid diethanolamides. Further examples of nonionic detergent surfactants may be found in M. Schick's textbook "Nonionic Surfactants", M. Dekker Inc., New York, 1967. Mixtures of various nonionic surfactants may also be used. Tertiary amine oxides such as higher alkyl di(lower hydroxy alkyl) amine oxides, e.g. lauryl dihydroxyethyl amine oxide, may also be used as a suitable nonionic surfactant.

For optimum detergency, the shorter alkyl chain length nonionic surfactants are preferred, particularly when the degree of alkoxylation is relatively low. Thus, the alkoxylated $C_9$–$C_{11}$ alcohols are preferred over the correspondingly alkoxylated $C_{12}$–$C_{15}$ alcohols, and the $C_9$–$C_{11}$ alcohols condensed with 5 moles of ethylene oxide are preferred over the same alcohols but condensed with 8 moles of ethylene oxide.

The HLB-value of the nonionic surfactant or mixture of nonionic surfactants, when dissolved in water, should lie between about 10 and about 15. Nonionic surfactants with an HLB-value of below about 11 are generally not soluble in water to any appreciable extent without another active detergent present, but it is possible to dissolve higher levels of such low HLB-nonionic surfactants in mixtures of water and an organic solvent.

For optimum streak-free results the nonionic surfactant should preferably provide a cloud point of the aqueous solution of the final composition above the temperature of normal use of the diluted solution.

This can be achieved by a proper choice of the type of nonionic surfactant or mixtures of various nonionic surfactants or by the co-use of another detergent surfactant, such as an anionic or amphoteric surfactant.

In general, from 0.01–98% by weight of the final composition of one or more nonionic surfactants will be present in the final composition. Usually, this amount will range from 2 to 30% by weight, and it has been found that at least 5% should be present to obtain both a reduced streaking and an improved cleaning effect. Preferably therefore, the amount of nonionic detergent surfactant will range from 5–30%, and especially preferably from 7–25% by weight of the final composition.

The at least partially esterified resin to be used in the present invention can be either partly derived from natural sources or wholly synthetic in origin. An example of a resin partly derived from natural sources is the at least partially esterified adduct of rosin and an unsaturated dicarboxylic acid or anhydride.

Examples of wholly synthetic resins are at least partially esterified derivatives of co-polymerisation products of mono-unsaturated aliphatic, cycloaliphatic or aromatic monomers having no carboxy groups and unsaturated dicarboxylic acids or anhydrides thereof. Normally, these copolymers will contain equimolar proportions of the monomer and the dicarboxylic acid or anhydride, but copolymers with higher ratios of monomer to dicarboxylic acid or anhydride are also suitable, provided they can be solubilized in the liquid medium.

Typical examples of suitable copolymers are copolymers of ethylene, styrene, and vinylmethylether with maleic acid, fumaric acid, itaconic acid, citraconic acid and the like and the anhydrides thereof. Preferred are the styrene/maleic anhydride copolymers.

The partly natural or wholly synthetic resins are at least partially esterified with a suitable hydroxyl containing compound. Examples of suitable hydroxyl containing compounds are aliphatic alcohols such as methanol, ethanol, propanol, iso-propanol, butanol, isobutanol, ethylhexanol and decanol, higher primary alcohols, glycol ethers such as the butyl ether of ethylene glycol and polyols such as ethylene glycol, glycerol, erythritol, mannitol, sorbitol, polyethylene glycol, polypropylene glycol, and so on. The choice of the esterification agent and the degree of esterification depend upon the solubility requirements of the at least partially esterified resin in an (alkaline) liquid medium of the type hereabove described and the viscosity profile of the compositions of the invention in practical use. The choice of the esterification agent and the degree of esterification also influence the water hardness sensitivity of the at least partially esterified resin in the compositions of the invention when for example these are diluted with hard water either for large surface area cleaning or during rinsing. For optimum streak-free results the choice of esterification agent and the degree of esterification should be such as to give an at least partially esterified resin which when used in the compositions of the invention does not give a cloudy solution when diluted with hard water, due to precipitation of the calcium or magnesium salt of the resin or salting out of the resin by the hardness salts present in the water. It is to be understood that the choice of the esterification agent does not embrace the nonionic surfactants mentioned above.

The at least partial esterification is to be understood to imply that at least 5%, preferably at least 10% and especially preferably at least 20%, particularly 25% of the free carboxy groups of the resin are esterified with the hydroxyl group containing compound. The esterification can also be complete, i.e. 100% of the free carboxy groups are esterified. It is to be understood that the latter compound does not embrace the nonionic detergent surfactants mentioned above.

Typical examples of at least partially esterified resins for use in the present invention are partially esterified adducts of rosin with maleic anhydride, such as the products SR 83, SR 88, SR 91 (ex Schenectady Chemicals), having an esterification degree of about 65, about 50 and about 50% respectively; Durez 17211 and Durez 15546 (ex Hooker Electro-Chemical Co), having an esterification degree of about 60 and 65% respectively; Alresat KM 140 (ex Hoechst), having an esterification degree of about 40%; Pentalyn 255 (ex Hercules); SMA 1140 H, SMA TM 9123 and SMA TM 7092 (ex Arco Co), having an esterification degree of about 70, about 50 and about 60% respectively; Ubatol R 300 and R 400 (ex Staley), styrene-based copolymers having an esterification degree of about 40% Shanco 334 (ex Shanco Plastics), a modified polyester resin having an esterification degree of about 40%; partially esterified copolymers of styrene with maleic anhydride, esterified with lower alkanols such as Scripset 520, 540 and 550 (ex Monsanto), having an esterification degree of about 20, about 45 and about 45% respectively, and polyvinylmethylether/maleic anhydride copolymers, partially esterified with butanol, such as Gantrez ES 425 (ex GAF Corp.), having an esterification degree of about 50%.

Suitable examples of the preferred esterified resins are the partially lower alkanol esterified copolymers of styrene with maleic anhydride, e.g. Scripset 540 and 550 the esterifying alcohol in the latter being sec.-butanol (ex Monsanto), partially esterified adducts of rosin with maleic anhydride, e.g. SR 91 (ex Schenectady Chemicals) and Alresat KM 140 (ex Hoechst), modified polyester resins, e.g. Shanco 334 (ex Shanco Plastics) and polyvinyl methylether/maleic anhydride copolymers, partially esterified with butanol, e.g. Gantrez ES 425, (ex GAF Corp.)

Mixtures of various partially or fully esterified resins may also be used, as well as mixtures of partially or fully esterified and non-esterified resins. Thus, mixtures of Scripset 550 and SR 91, Scripset 550 and Shanco 334, and SR 91 and Shanco 334 give good results, as well as mixtures of Scripset 550 and SMA 2000A (which is a non-esterified styrene-maleic anhydride copolymer).

The molecular weight of the resins of the invention may vary from about a thousand to a few million. The at least partially esterified resins should have a sufficient solubility in a neutral or alkaline liquid medium, preferably in an aqueous medium. The at least partially esterified resin, if it contains anhydride groups, may if necessary be hydrolysed and subsequently neutralized or made alkaline so that in normal use it is present in the compositions of the invention in soluble form as the alkalimetal, ammonium or substituted ammonium or alkaline earth metal salt, or as the salt of a suitable amine or mixtures thereof. This of course does not apply to the fully esterified resins.

In general, the compositions of the invention will contain from 0.05 to 20%, usually from 0.1 to 15% and preferably from 0.5 to 10% by weight of the at least partially esterified resin. The weight ratio between the nonionic detergent and the at least partially esterified resin can vary widely between the above ranges for these materials. Usually this weight ratio will preferably be more than 1. The at least partially esterified resin may be incorporated in the final composition after having been prepared separately, or it may be prepared in situ. In the latter case, however, a careful control and adjustment of the amount of esterifying hydroxy compound is necessary.

It has furthermore been found that best results are obtained with the compositions of the invention if they are substantially electrolyte salt-free. This is to be understood in this way that the compositions, apart from their above-described essential ingredients, do not contain further inorganic electrolyte salts in an amount of more than 5% by weight. It may sometimes be useful to include a low amount of a buffer salt such as alkali-metaborates, -carbonates, or a builder salt such as phosphates, citrates, NTA, EDTA, Dequest, etc. but generally the compositions contain less than 3% and generally less than 0.5% or even no further inorganic electrolyte salts at all.

The compositions may furthermore contain optional ingredients such as preservatives, bactericides, hydrogen peroxide, thickening agents, organic buffers such as the alkanolamines, colouring agents, perfumes and plasticizers. They may also contain, besides the nonionic detergent surfactants, low levels of other detergent surfactants which should preferably be rather calcium-insensitive. Typical examples thereof are the fatty acid soaps, the alkylaryl sulphonates, alkylether sulphates i.e. the sulphation products of the above-described nonionic detergent surfactants, secondary alkane sulphonates, amphoteric surfactants and mixtures thereof. The compositions of the invention are normally alkaline; if necessary, the pH is adjusted to alkaline values by means of a suitable alkaline material. In this case the alkaline material is not understood to be included in the inorganic electrolyte salts as discussed above.

The products of the invention may be used as such i.e. neat, or they may be diluted with water before use to a concentration of generally from 0.1 to 10%.

The invention will now be illustrated by way of example.

EXAMPLE 1

The following liquid composition was prepared.

| | % by weight |
|---|---|
| $C_{13}$–$C_{15}$ primary alcohol having an about 60% linear and about 40% branched alkyl chain, condensed with 7 moles ethylene oxide (HLB-value 12.2) | 10 |
| Partial sec.-butanol ester of a styrene-maleic anhydride copolymer, neutralized to the sodium salt (av.mol.wt.~10.000: theor. acid number~190; esterification degree~45%) | 2 |
| Demineralized water, perfume | to 100 |

This product was compared as regards the streaking behaviour with a number of current commercial general-purpose cleaning compositions in a panel consisting of twenty members. The performance of the products on both clean surfaces and a range of surfaces (windows, mirrors, black tiles) soiled with different soils was explored, using a one-wipe cleaning procedure. Overall, the above product was significantly preferred (i.e. gave the least formation of streaks). On shoe polish type of soils the above product was somewhat inferior to the current products. In clean systems, the product gave a higher foam profile, and in the presence of soil a medium foam profile. The products were used at a concentration of 10 g/l in water of 23° German hardness at room temperature.

EXAMPLE 2

The procedure of Example 1 was repeated with a formulation which contained the same nonionic detergent surfactant, but a different partially esterified resin, viz. a vinylmethylether/maleic anhydride copolymer, partially esterified with butanol. The amounts of nonionic detergent surfactant and resin were 10% and 2% respectively. The product was evaluated both neat and diluted in hard and soft water. The results were somewhat lower than in Example 1, but there was clearly a non-streak effect. It gave a clear solution in hard water (Ca/Mg 32:8) at a concentration of 10 g/l, whereas the non-esterified resin produced a precipitate therein.

EXAMPLE 3

The following liquid composition was prepared:

| | % by weight |
|---|---|
| $C_9$–$C_{11}$ primary straight chain alcohol, condensed with 5 moles ethylene oxide (HLB value 11.6) | 9.5 |
| Partial sec.-butanol ester of styrene-maleic anhydride copolymer neutralized to the sodium salt (av.mol.wt.~10.000; theor. acid number ~190; esterification degree~45%) | 1.0 |
| Water | balance |

The procedure of Example 1 was repeated and the above composition was found to give substantially the same results as the formulation of Example 1 in terms of the appearance of the surface after cleaning i.e. formation of streaks. However, the above composition was much preferred for cleaning porous ceramic floor tiles soiled with a mixture of vacuum chamber dust and fat. At a concentration of 10% in water of 23° German hardness at room temperature, the above composition gave a detergency efficiency of 55%, whereas the formulation of Example 1 only gave a detergency efficiency of 25%.

EXAMPLE 4

The following liquid compositions were prepared:

| | % by weight |
|---|---|
| $C_9$–$C_{11}$ primary straight chain alcohol, condensed with 5 moles of ethylene oxide (HLB value 11.6) | 6 |
| $C_{14}$–$C_{15}$ primary straight chain alcohol, condensed with 18 moles of ethylene oxide (HLB value 15.7) | 3 |
| Partially esterified resin | x |
| Water | balance |

As resin, Scripset 540 or Scripset 520 was included at 1% (x=1), Pentalyn 255 or Alresat KM 140 at 2% (x=2).

In a test as in Example 1 at 45° C., good non-streak results were obtained, at 10 g/l with water of 23° German hardness.

EXAMPLE 5

A liquid composition containing 2% of the nonionic surfactant of Example 1 and 10% of the resin of Example 1 produced good non-streak results at 10 g/l in water with a low hardness.

EXAMPLE 6

A liquid composition comprising 7% of the nonionic surfacant of Example 3, 1% of the resin of Example 3, and 0.5% sodium citrate gave good non-streak results at 10 g/l in water of 23° German hardness at room temperature.

EXAMPLE 7

A liquid composition containing 7% of the nonionic surfactant of Example 3, 3% of the resin SR 91 and 2% of sodium citrate gave good non-streak results at 10 g/l in water of 23° German hardness at room temperature.

EXAMPLE 8

A liquid composition containing 2% of the nonionic surfactant of Example 1 and 9% of the resin of Example 1 gave good non-streak results at 10 g/l in water of 24° French hardnes at room temperature.

EXAMPLE 9

A liquid composition containing 9% of the nonionic surfactant of Example 1, 3% of the resin of Example 1, 2% hydrogen peroxide and 0.2% Dequest 2041 (=ethylenediaminetetraphosphonic acid) gave good non-streak results at 10 g/l in water of 40° French hardness at room temperature.

EXAMPLES 10-11

The following liquid compositions were prepared:

| | Ex. 10 % by weight | Ex. 11 % by weight |
|---|---|---|
| nonionic surfactant of Example 3 | 7 | 7 |
| sodiumlaurylethersulphate | 2 | 2 |
| resin of Example 3 | 1 | 1 |
| dyestuff | + | + |
| perfume | 0.4 | 0.4 |
| hydroxyethylcellulose | — | 0.45 |
| pH | 8 | 8 |
| viscosity (cP) | about 10 | about 40 |

These products gave good non-streak results in a test as in Example 1.

EXAMPLE 12

For comparison purposes, Example 1 was repeated, but with an anionic synthetic detergent instead of the nonionic synthetic detergent. The anionic synthetic detergent was sodiumdodecylbenzenesulphonate. This formulation gave an unacceptable streaky film.

EXAMPLE 13

Example 1 was repeated, but with varying amounts (0.5-5%) of added electrolyte salts (sodium chloride or sodium citrate). The level of the partially esterified resin was either 2% or 1%.

The following observations were made:

The end results became poorer the higher the level of electrolytes, which was more pronounced at the 1% level of the resin than at the 2% level. The end results with sodium citrate were better than with sodium chloride.

EXAMPLE 14

Example 1 was repeated, using various nonionic detergents with different HLB-values, with a level of the resin at 2% and at 1%. The following nonionic detergents were used:

A. $C_9$-$C_{11}$ primary straight chain alcohol, condensed with x moles of ethyleneoxide, having the following HLB values

| nr | x | HLB |
|---|---|---|
| 1 | 2.5 | 8.1 |
| 2 | 3 | 8.8 |
| 3 | 4 | 10.5 |
| 4 | 5 | 11.6 |
| 5 | 6 | 12.5 |
| 6 | 8 | 13.7 |
| 7 | 12 | 15.5 |

B. $C_{13-15}$ primary alcohol, having about 60% linear and about 40% branched alkylchain, condensed with y moles of ethyleneoxide, having the following HLB-values:

| nr | y | HLB |
|---|---|---|
| 1 | 3 | 7.8 |
| 2 | 4 | 9.1 |
| 3 | 6 | 11.2 |
| 4 | 7 | 12.2 |
| 5 | 9 | 12.5 |
| 6 | 14 | 14.9 |
| 7 | 20 | 16.2 |

The following results were obtained:

(a) Product stability

The products with nonionics A1, A2, B1 and B2 were turbid and unstable at room temperature (except with nonionic A2 in the formulation containing 2% of the resin). The tests with these formulations were therefore carried out after shaking, which produced a temporarily homogeneous system. All other nonionics gave stable products.

(b) Streak-free end result

All products containing nonionics A1, A2, B1 and B2 gave unacceptable streaky films. All other products gave acceptable end results.

(c) Cleaning power

The following results in terms of % detergency efficiency were obtained with the formulation containing 2% of the resin (Each result is the average of 4 measurements).

| Formulation with nonionic | % Detergency efficiency |
|---|---|
| A1 | 60 |
| A2 | 63 |
| A3 | 64 |
| A4 | 62 |
| A5 | 60 |
| A6 | 54 |
| A7 | 51 |
| B1 | 51 |
| B2 | 54 |
| B3 | 58 |
| B4 | 54 |
| B5 | 54 |
| B6 | 52 |
| B7 | 50 |

It is claimed:

1. A liquid general-purpose cleaning composition with improved non-streak and cleaning properties, comprising: (a) 0.01–98% by weight of a nonionic surfactant, having an HLB-value of between 10 and 15, (b) 0.005–20% by weight of an at least 5% alcohol esterified resin copolymer formed from an unsaturated monomer and an unsaturated dicarboxylic acid or anhydride, and (c) 1–99.985% of a compatible liquid medium.

2. A composition according to claim 1, comprising 5–30% by weight of the nonionic surfactant, 0.1–15% by weight of the at least 5% alcohol esterified resin copolymer and 50–97.9% of the compatible liquid medium.

3. A composition according to claim 1, comprising 7–25% by weight of the nonionic surfactant, 0.5–10% by weight of the at least 5% alcohol esterified resin copolymer and 55–92.5% by weight of the compatible liquid medium.

4. A composition according to claim 1, in which the esterification degree is at least 10%.

5. A composition according to claim 1, in which the esterification degree is at least 20%.

6. A composition according to claim 1, in which the at least 5% alcohol esterified resin copolymer is derived from an adduct of rosin and an unsaturated dicarboxylic acid or anhydride.

7. A composition according to claim 1, in which the at least 5% alcohol esterified resin copolymer is derived from a copolymer of a mono-unsaturated aliphatic, cycloaliphatic or aromatic monomer having no carboxy groups, and an unsaturated dicarboxylic acid or anhydride.

8. A composition according to claim 7, in which the at least 5% alcohol esterified resin copolymer is a copolymer of styrene with maleic anhydride, partially esterified with secondary butanol.

9. A composition according to claim 1, comprising apart from the essential ingredients listed in claim 1 no more than 5% of additional inorganic electrolyte salts.

* * * * *